US007584565B2

(12) United States Patent
Zebersky

(10) Patent No.: US 7,584,565 B2
(45) Date of Patent: Sep. 8, 2009

(54) JIGSAW PUZZLE DISPLAY FRAME

(75) Inventor: Laura Zebersky, Sunrise, FL (US)

(73) Assignee: Jazwares, Inc., Sunrise, FL (US)

( * ) Notice: Subject to any disclaimer, the term of this patent is extended or adjusted under 35 U.S.C. 154(b) by 59 days.

(21) Appl. No.: 11/868,310

(22) Filed: Oct. 5, 2007

(65) Prior Publication Data

US 2008/0083149 A1 Apr. 10, 2008

Related U.S. Application Data

(60) Provisional application No. 60/828,308, filed on Oct. 5, 2006.

(51) Int. Cl.
*A47G 1/06* (2006.01)

(52) U.S. Cl. ..... 40/716; 40/575; 40/714

(58) Field of Classification Search ..... 40/367, 40/464, 575, 716, 714, 541, 576; 434/406; 273/157 R See application file for complete search history.

(56) References Cited

U.S. PATENT DOCUMENTS

| | | | | | |
|---|---|---|---|---|---|
| 3,641,291 | A | * | 2/1972 | Carling | 200/437 |
| 4,111,425 | A | * | 9/1978 | Lathrop | 273/157 R |
| 4,164,822 | A | * | 8/1979 | Batton | 40/361 |
| 4,228,596 | A | | 10/1980 | Daniel | |
| 4,417,732 | A | | 11/1983 | Guill | |
| 4,491,326 | A | | 1/1985 | Halsey, III | |
| 4,510,708 | A | * | 4/1985 | Pokrinchak | 40/361 |
| 4,605,231 | A | | 8/1986 | Richman | |
| 4,741,534 | A | | 5/1988 | Rogahn | |
| 4,799,680 | A | * | 1/1989 | Weimar | 273/157 R |
| 4,893,817 | A | * | 1/1990 | Shilo | 273/157 R |
| 5,026,288 | A | | 6/1991 | Castiglia et al. | |
| 5,090,701 | A | | 2/1992 | Chang | |
| 5,127,652 | A | | 7/1992 | Unger | |
| 5,411,262 | A | | 5/1995 | Smith | |
| 5,462,281 | A | * | 10/1995 | Gaito et al. | 273/238 |
| 5,683,087 | A | | 11/1997 | Henshaw et al. | |
| 5,711,523 | A | * | 1/1998 | Sternberg et al. | 273/153 R |
| 5,820,383 | A | | 10/1998 | Levins | |
| 5,895,044 | A | | 4/1999 | Bahramian | |
| 5,921,548 | A | | 7/1999 | Goldberg | |
| 6,027,117 | A | | 2/2000 | Goldberg | |
| 6,216,373 | B1 | * | 4/2001 | Liao | 40/544 |
| 6,547,243 | B2 | | 4/2003 | Juenger | |
| 2002/0105138 | A1 | | 8/2002 | Juenger | |
| 2004/0116038 | A1 | | 6/2004 | Hunts | |
| 2006/0111010 | A1 | | 5/2006 | Park | |
| 2006/0138725 | A1 | | 6/2006 | Zhitomirskaya | |
| 2007/0039523 | A1 | | 2/2007 | Helzer | |

OTHER PUBLICATIONS

International Search Report and Written Opinion, (PCT/US07/80604), 5 pages, dated Jun. 17, 2008.

* cited by examiner

*Primary Examiner*—Lesley D. Morris
*Assistant Examiner*—Christopher E Veraa
(74) *Attorney, Agent, or Firm*—Lackenbach Siegel, LLP; Andrew F. Young

(57) ABSTRACT

A lighted display frame for a jigsaw puzzle includes a light transmissive top and a switch activating slide actuator which results in a light emitting element illuminating the puzzle, the slide actuator being actuated by engagement of the puzzle therewith.

8 Claims, 6 Drawing Sheets

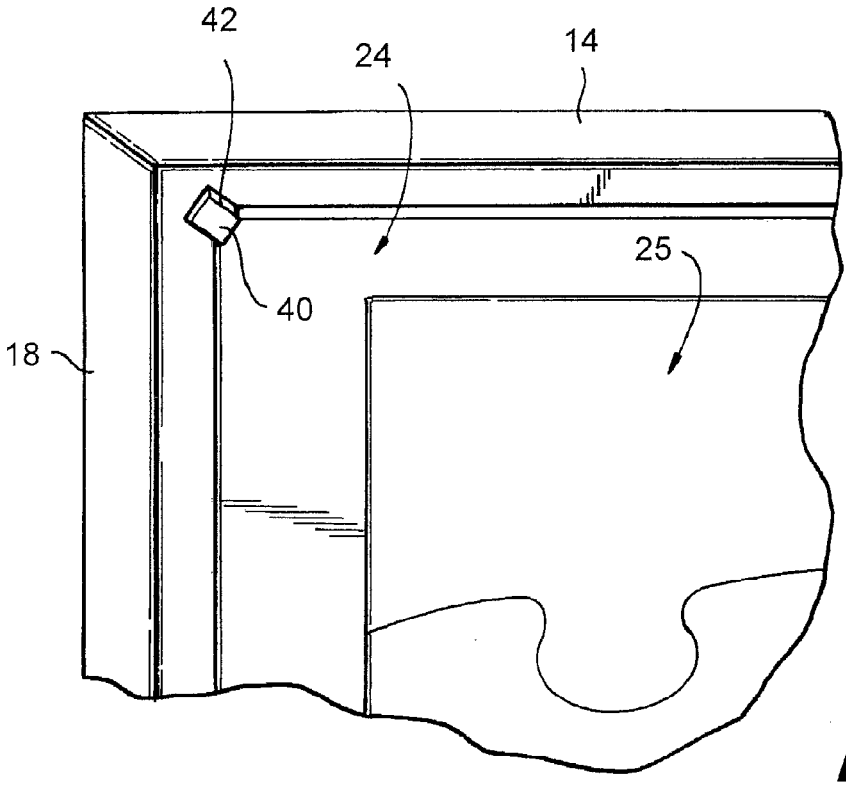
Fig. 4
Fig. 5
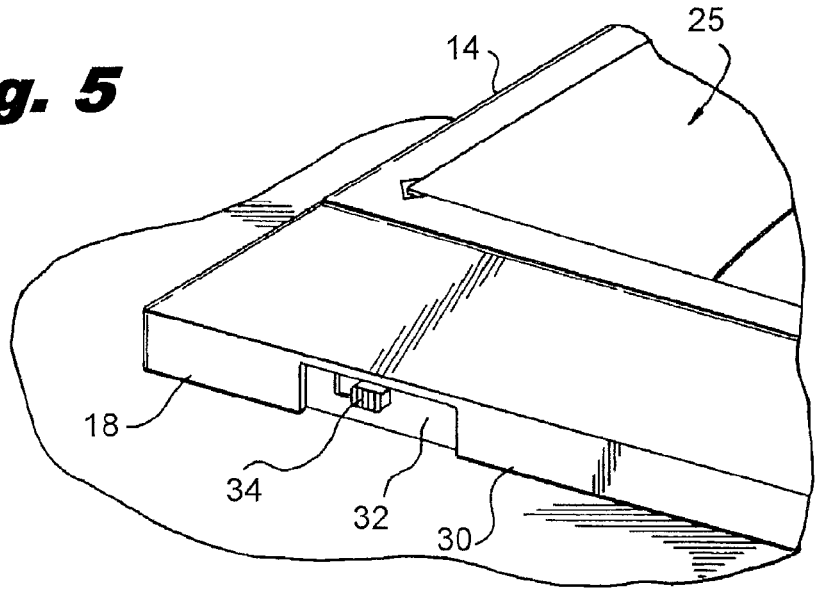

JIGSAW PUZZLE DISPLAY FRAME

CROSS-REFERENCE TO RELATED APPLICATIONS

This application claims the benefit of priority of U.S. Provisional Application No. 60/828,308 filed on Oct. 5, 2006, the contents of said provisional application are hereby incorporated by reference in their entirety.

BACKGROUND OF THE INVENTION

1. Field of the Invention

The present invention related to a jigsaw puzzle display frame on which a jigsaw type puzzle can be assembled. In particular, the invention relates to a frame that, on completion of the assembly of the puzzle pieces on a top surface of the frame unit, illuminates the assembled puzzle to enhance the appearance and artistic character of the intended scene depiction.

2. Description of the Related Art

The various and many types of jigsaw puzzles have been long known. It is also known to assemble the puzzle pieces on a support such as a plate or board, and then enclose the puzzle and plate within a frame coupled with covering the puzzle with a protective plexiglass sheet. See, for example, U.S. Patent Application Publication No. 2005/0282139 by Hughes published on Dec. 22, 2005. The present inventor, though, has no present knowledge of a display frame unit being employed to provide a top on which the puzzle is assembled and illuminated when assembly has been completed.

OBJECTS AND BRIEF SUMMARY

An object of the preferred embodiment to provide a display frame on which a jigsaw puzzle can be assembled, following assembly, the completed puzzle being illuminated to highlight the appearance of the puzzle scene.

Another object of the preferred embodiment is to provide a display frame which is particularly suited for assembling and illuminating jigsaw puzzles which comprise translucent material puzzle pieces.

Another object of the preferred embodiment is to provide a display frame which can be used with translucent material puzzles and vivid color sharpened puzzles that are of particular appeal to young people.

Another object of the preferred embodiment is to provide a display frame which rewards children and other people who successfully solve or properly assemble a jigsaw puzzle by illuminating the puzzle as a mark of accomplishment and satisfaction to the person.

In one aspect, the preferred embodiment provides a display frame for assembling and mounting a jigsaw puzzle, which includes a frame housing having spaced top and bottom frame margin pieces and spaced left and right end margin pieces extending between opposite ends of said top and bottom margin pieces. These margin pieces define a continuous frame that encircles a light transmissive, preferably, translucent material assembly plate that is recessed below a top face surface of the continuous frame. This recessing arrangement facilitates utilization of the assembly plate as a surface on which a user manipulates and effects joinder together of mating pieces of a jigsaw puzzle. During user assembly of the puzzle pieces, edges of perimeter located puzzle pieces of an assembled puzzle closely abuttingly engage inner side faces of the continuous frame. A slide actuator member is carried at a location on the encircling frame such that an end edge of a puzzle piece on the assembly plate and which puzzle piece juxtaposes with said slide actuator functions to urge the slide actuator counter to a bias acting thereon and moves it from an non operating position to an operating position; One or more light emitting members are carried in the frame housing these being disposed behind the assembly plate. A source of electric power, i.e., a battery is provided for operating light emitting members. An on-off switch in circuit with the battery and light emitting members also is provided. A normally open cut-out switch is provided for interrupting a power flow from the battery to light emitting members. The slide actuator is connected with the cut-out switch such as to move the cut-out switch from open to closed condition. This occurs responsive to movement of said slide actuator from non-operating to operating position caused by engagement of a puzzle piece with the slide actuator and attendant sliding of the actuator in a slot in the encircling frame. This sliding of the actuator is effected counter to a spring bias acting on the slide member tending to maintain the cut-out switch open. When the cut-out switches closes, power can flow to any light emitting device illuminating same and the light generated therewith transmits through the assembly plate to illuminate a puzzle mounted on the assembly plate.

The above, and other objects, features and advantages of the preferred embodiment of the invention will become apparent from the following description read in conjunction with the accompanying drawings, in which like reference numerals designate the same elements.

BRIEF DESCRIPTION OF THE DRAWINGS

FIG. 4 is a fragmentary perspective view of the left side top corner intersection of the frame left side and top side margin pieces in the preferred embodiment of the invention;

FIG. 5 is a fragmentary top left side perspective view of the frame unit and mounted puzzle showing location of a slide operated on-off switch mounted at the left side frame margin structure and used to connect a power supply battery to electric circuitry housed within the frame unit in the preferred embodiment of the invention;

DESCRIPTION OF THE PREFERRED EMBODIMENTS

Figure 1:
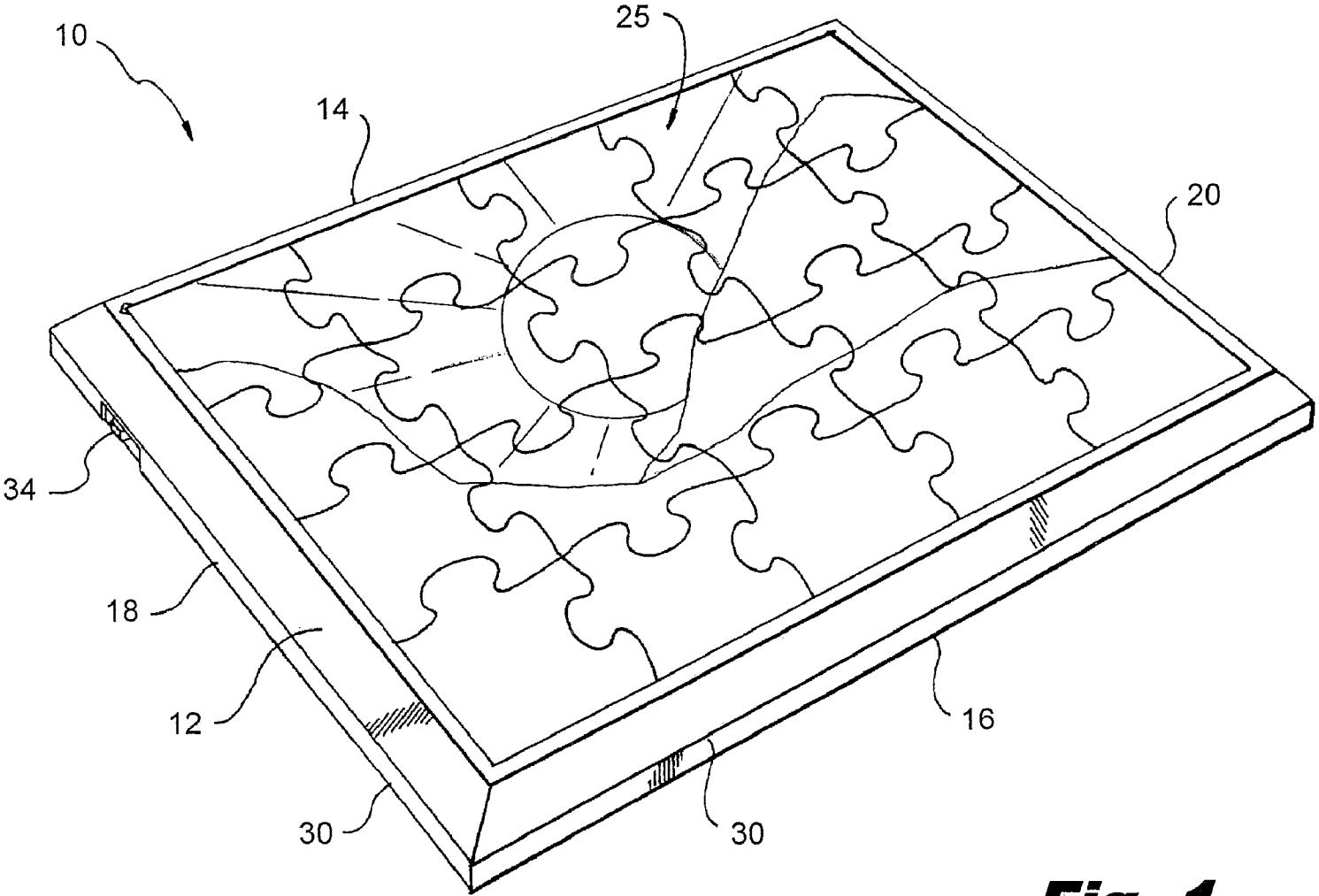
FIG. 1 is a top left side perspective view of an illuminated puzzle, the puzzle pieces being assembled together one with others and mounted in a display frame according to a preferred embodiment of the invention.

Referring to FIG. 1, display frame unit 10 includes a frame housing 12 comprised of an encircling upper frame that includes spaced apart top margin piece 14 and bottom margin piece 16, these being connected at opposites ends with left margin piece 18 and right margin piece 20. A top comprised of a light transmissive material, such as assembly plate 24 shown in FIG. 4, sets a slight distance below a top surface of the encircling frame, this to accommodate insertion of puzzle pieces 26 in the recess or well defined by the upper surface of assembly plate 24 and the in inner side wall surfaces of the encircling marginal pieces 14, 16, 18 and 20. The bottom (not shown) is separated and spaced from assembly plate 24 so that a recess is formed therebetween.

The upper frame made up of the margin pieces also has outer downwardly depending wall parts 30 so that the encircling upper frame sets on and around a housing lower body part seen best in FIG. 5 as at 32, the lower body carrying an optional on-off switch 34 the purpose of which will be described later. The lower body part 32 surrounds the recess between the assembly plate 24 and bottom and other switches, one or more light emitting elements and a battery power source are housed in the recess. Instead of the battery power used in the illustrated preferred embodiment, AC power may be used and the power circuitry is located in the recess. The housing upper frame and lower body part are made of any one of a number of moldable opaque plastic materials suitable for the purpose herein involved.

Figure 2:
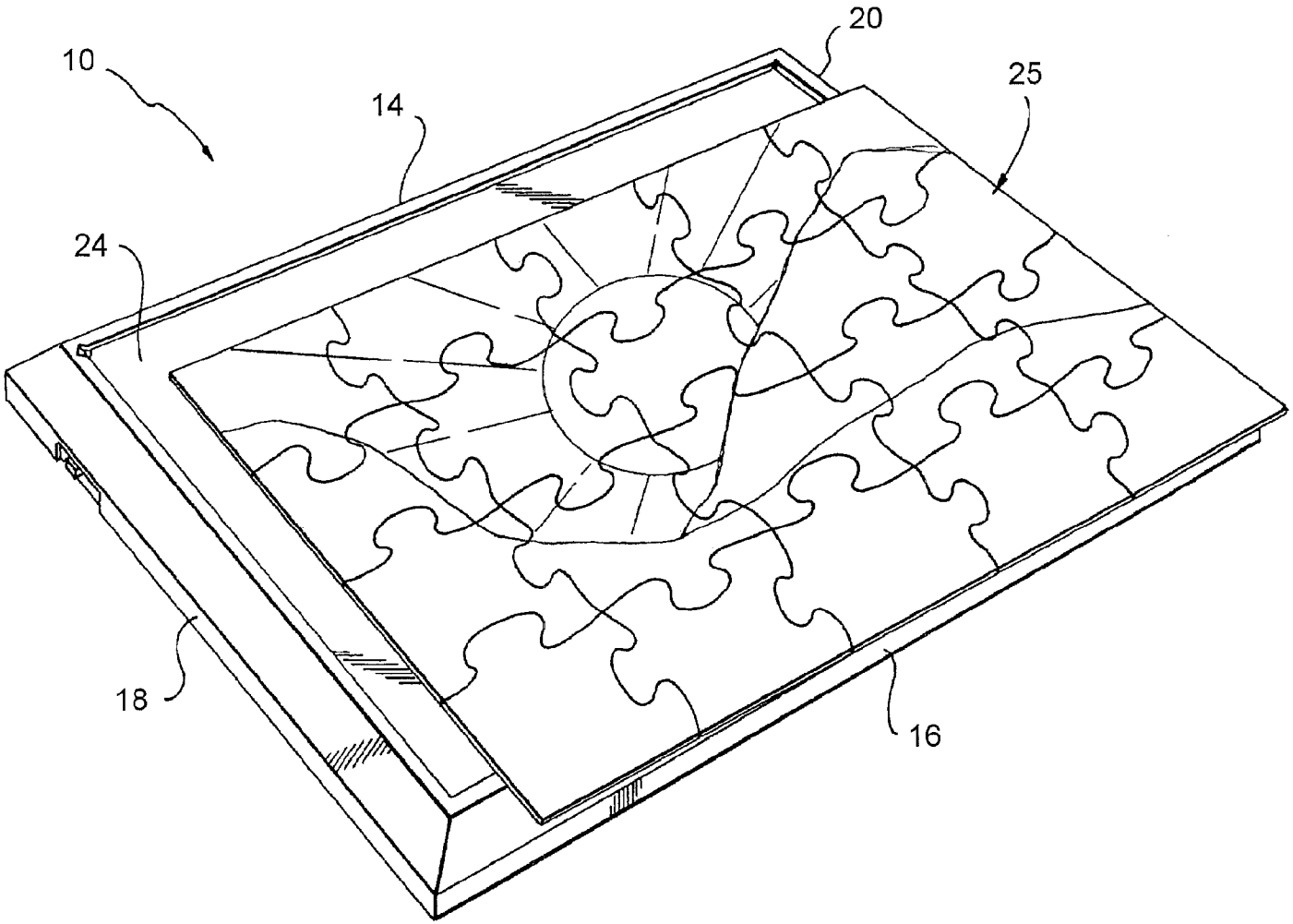
FIG. 2 is a top front perspective of the assembled puzzle shown removed intact from the frame so as to show the top of the frame as well as the top, bottom and opposite side frame margin pieces in the preferred embodiment of the invention.
Figure 3:
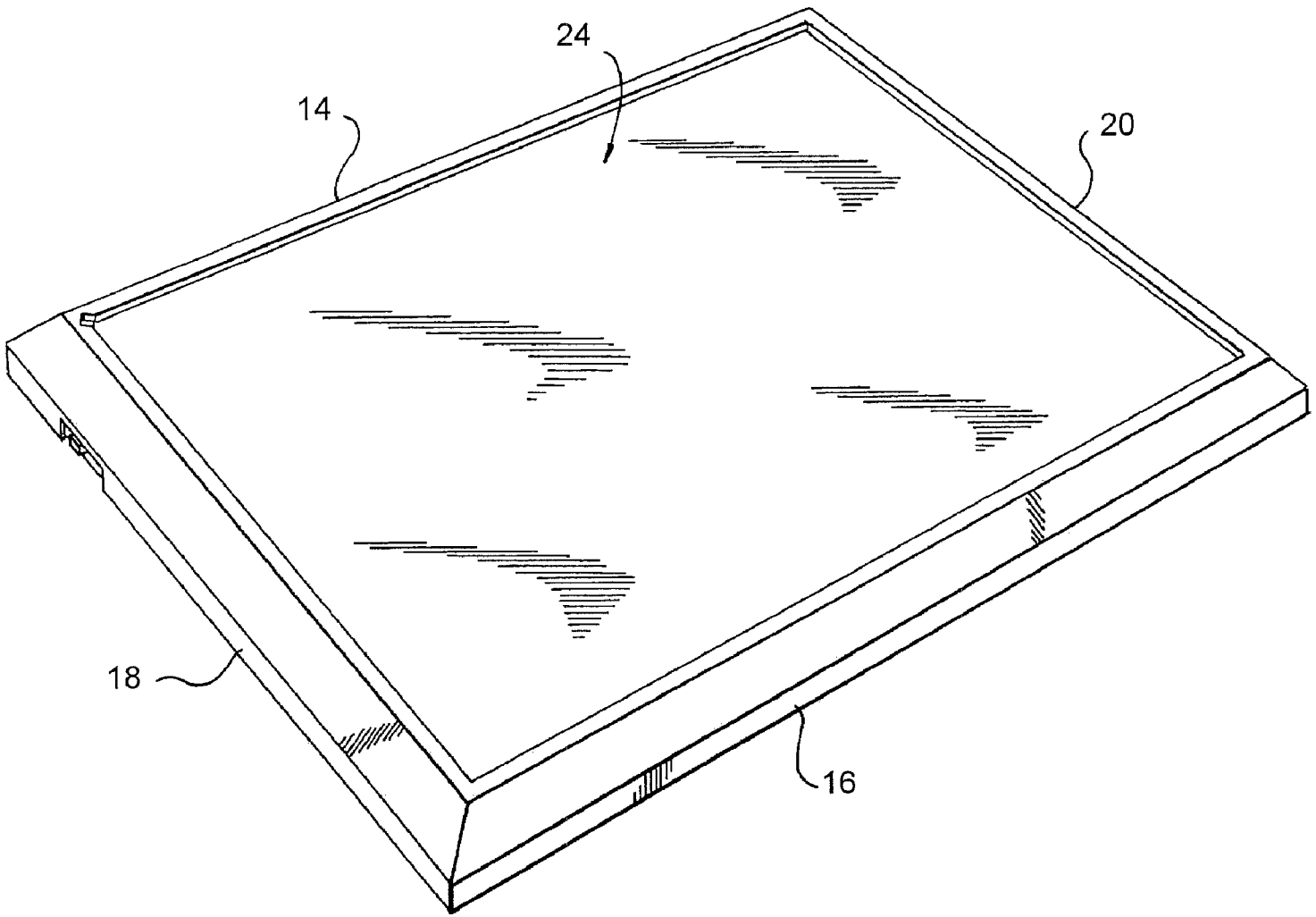
FIG. 3 is a top front perspective view of the frame unit of the preferred embodiment as it appears prior to the start of assembling puzzle pieces.
Figure 6:
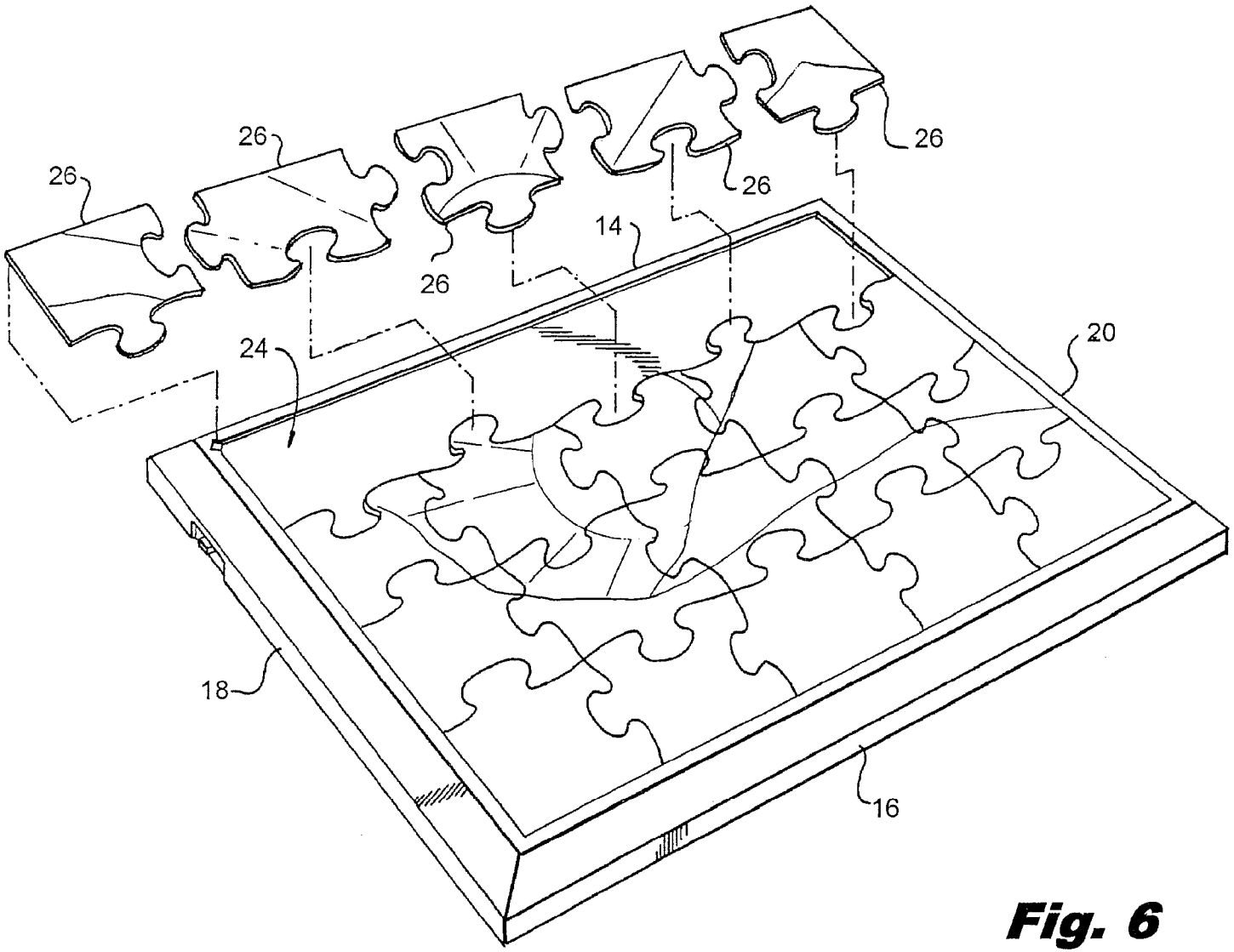
FIG. 6 is a top view of a partly assembled segment of puzzle pieces as well as other non connected ones of said pieces in the preferred embodiment of the invention.

FIG. 1 shows an assembled or "solved" jigsaw puzzle 25 received in the above described recess, the puzzle being a scene depicting several comic book characters—FIG. 3 shows housing 12 without a puzzle set on the assembly plate 24. Preferably, the puzzle pieces 26 (FIG. 6) are made of a light transmissive material such as a thermoplastic. FIG. 2 depicts an assembled puzzle 25 that has been removed from the frame a short distance so as to enable a viewer to appreciate how close fitting the margins of the puzzle are within the well or recess so that the marginal edges of the puzzle engage with the inner side wall surfaces of the marginal pieces.

Referring to FIG. 4, the upper frame carries a slide actuator 40, slidable in a slot 42 in top margin piece 14, and located desirably at the intersection or joinder location of top margin piece 14 with left side margin piece 18. The slot 42 may alternatively be a recess or a well. It may also be located at any of the other three intersections, or even in the side of one of the margin pieces.

The slide actuator 40 is operatively connected with a normally open cut-out switch 44 housed within lower body part 32 serving the purpose as will be described later and with reference to FIG. 7. It is to be noted here that the slide actuator 40 overhangs the corner of assembly plate 24 such that it will be engaged by the assembled puzzle marginal left upper corner edge. In the preferred embodiment shown in the drawings, the puzzle piece has to be pushed into slide actuator 40 horizontally. Alternatively, slide actuator 40 may have a sloped top edge such that it moves even when the puzzle piece is pressed straight downward. Preferably, the person actually has to push the puzzle piece into place horizontally to Such engagement moves the actuator 40 in slot 42 from an actuator non operating condition to an operating condition.

The slide actuator 40 is moved by the puzzle piece in slot 42 in a horizontal direction away from the center of the frame. The slide actuator 40 is biased so that it pushes back on the puzzle piece. If the puzzle is not fully assembled, the biasing force will push the puzzle piece toward the center of assembly plate 24 and the puzzle will not be illuminated. The puzzle must be completed so that the biasing force of slide actuator 40 merely pushes the assembled puzzled pieces against the inside walls of opposing margin pieces 16 and 20. If the biasing force is strong enough, slide actuator 40 may push the assembled puzzle pieces tightly enough against the inside walls of opposing margin pieces 16 and 20 that it tends to hold the jigsaw puzzle pieces on the top even when the frame with the assembled puzzle is jostled or moved. Alternatively, slide actuator may move in both horizontal and vertical directions (away and up) such that it tends to push downward on the puzzle piece as well as inwardly thus clamping the puzzle pieces in place.

Figure 7:
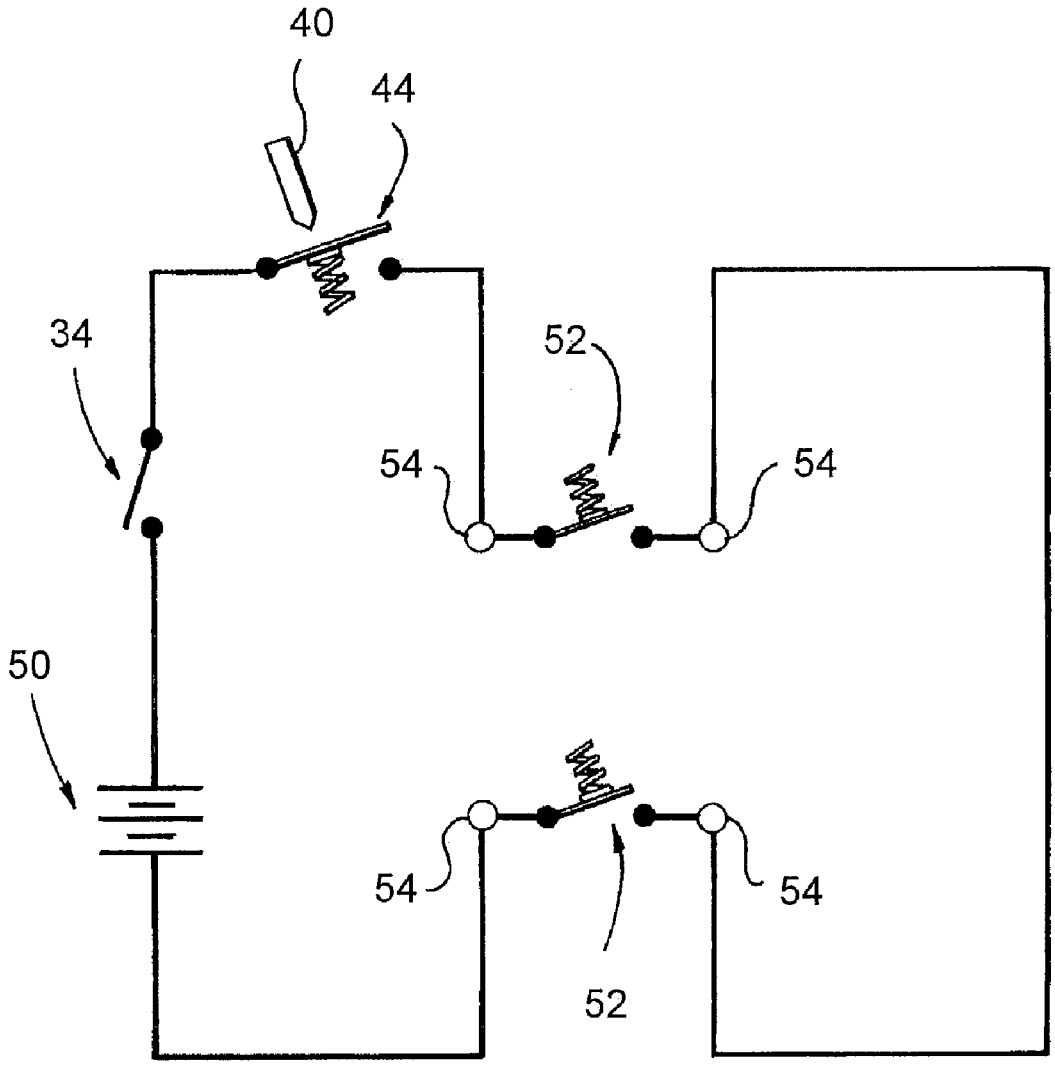
FIG. 7 is an illustration of one possible embodiment of wiring arrangement which can be employed for illuminating the assembly plate member to highlight the scene of the puzzle that has been assembled thereon.

Referring to FIG. 7, circuitry including the depicted switch circuit is employed in the recess between assembly plate 24 and the bottom of the frame to enable illuminating an assembled puzzle 25 upon completion of assembly and solving of the puzzle. With the puzzle on the assembly plate 24, and with the slide actuator 40 having been moved from a first position to a second position corresponding to an operating condition by the action of the puzzle piece described above, the circuit may operate so that light is emitted. The light emission may be dependent on the on-off switch 34 be turned on to allow connection to the battery power or AC power.

FIG. 7 depicts use of optional pressure switches 52 in the circuitry with the light emitters 54 which are disposed in lower body part 32 behind the assembly plate 24. With these pressure switches in the circuit loop, it is necessary for the user to press the puzzle face at locations where the open pressure switches are embodied in order for power to be provided to the light emitting elements. This pressure will close the circuit to allow power flow to the light emitters 54. The pressure switches need not be used and if eliminated from the circuit 60, the light emitters 54 would light when the slide actuator 40 is moved to the second position corresponding to the operating condition. Furthermore, the pressure switches may be timed so that they only provide power to the light emitting elements for a period of time after they are pressed. These pressure switches may be employed in place of, or in addition to, the on-off switch 32.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A display frame unit for assembling and mounting a jigsaw puzzle, comprising:

a frame housing having spaced top and bottom frame margin pieces and spaced left and right end margin pieces extending between opposite ends of said top and bottom margin pieces;

a light transmissive assembly plate, said margin pieces defining a continuous frame encircling said assembly plate, said assembly plate being recessed inwardly of an outer encircling face surface of said margin pieces so as to provide a space for receiving jigsaw puzzle pieces during user assembly of said puzzle pieces, edges of perimeter located puzzle pieces of an assembled puzzle closely abuttingly engaging with inner side faces of said continuous frame;

a slide actuator member carried at a location on said encircling frame such that an end edge of a puzzle piece of an assembled puzzle present on said assembly plate which is juxtaposed with said slide actuator will urge said slide actuator counter to a bias acting thereon from an non operating position to an operating position;

at least one light emitting member carried in said frame housing disposed behind said assembly plate;

a source of electric power for operating said at least one light emitting member;

a on-off switch in circuit with said source of electric power and said light emitting member for controlling power supply to said light emitting member;

a normally open cut-out switch for interrupting a power flow from said battery to said light emitting member, said slide actuator being connected with said cut-out switch such as to move said cut-out switch to closed condition responsive to movement of said slide actuator from non-operating to operating position whereby with said off-on switch in on position, power will flow to said light emitting member illuminating said puzzle.

2. A display frame unit in accordance with claim 1, comprising a plurality of light emitting members disposed behind said assembly plate.

3. A display frame unit in accordance with claim 1, further comprising at least one normally open pressure actuatable switch carried in said housing and in circuit with said light emitting member so that with said on-off switch in closed condition, and said cut-out switch in closed condition, said light emitting member will not receive power unless a pressure is applied to actuate said pressure switch a closed condition.

4. A jigsaw puzzle frame for support of jigsaw puzzle pieces during an assembly process of the jigsaw puzzle, said jigsaw puzzle frame comprising:

a light transmissive top, generally planar and rectangular in shape, for supporting said jigsaw puzzle pieces;

a frame projecting upwardly from said top, said frame continuously mounted around the entire periphery of said top, said frame for holding said jigsaw puzzle pieces in place on said top when said puzzle is solved;

a bottom supporting said top and said bottom being spaced from said top so as to form a recess between said bottom and said top;

at least one light emitting element in said recess between said bottom and said top;

an actuator for said light emitting element positioned proximate said top, said actuator being movable between a first position and a second position;

said actuator being in said first position when the frame is empty and, when said puzzle is solved, engages with a jigsaw puzzle piece to be in said second position; and said actuator being biased so as to tend to hold said jigsaw puzzle pieces on said top when said frame is moved.

5. The jigsaw puzzle frame as recited in claim 4, wherein said light emitting element emits light when said actuator is in said second position.

6. The jigsaw puzzle frame as recited in claim 5, wherein said jigsaw puzzle pieces are translucent.

7. The jigsaw puzzle frame as recited in claim 6, wherein the inside walls of said frame extend perpendicularly from said top approximately one-quarter of an inch.

8. The jigsaw puzzle frame as recited in claim 7, wherein said light transmissive top is comprised of a translucent material and said frame is comprised of an opaque material.

* * * * *